US008899272B2

(12) United States Patent
Atkins

(10) Patent No.: US 8,899,272 B2
(45) Date of Patent: Dec. 2, 2014

(54) FLOW RESTRICTOR

(76) Inventor: Mark Atkins, Hampshire, IL (US)

( * ) Notice: Subject to any disclaimer, the term of this patent is extended or adjusted under 35 U.S.C. 154(b) by 460 days.

(21) Appl. No.: 13/152,633

(22) Filed: Jun. 3, 2011

(65) Prior Publication Data

US 2011/0297263 A1 Dec. 8, 2011

Related U.S. Application Data

(60) Provisional application No. 61/351,211, filed on Jun. 3, 2010.

(51) Int. Cl.

| | |
|---|---|
| ***G01F 1/42*** | (2006.01) |
| ***E03C 1/122*** | (2006.01) |
| ***E03F 3/04*** | (2006.01) |
| *E03C 1/12* | (2006.01) |

(52) U.S. Cl.

CPC ..... *E03C 1/1222* (2013.01); *E03F 3/04* (2013.01); *E03C 2001/1206* (2013.01)

USPC ..... 138/44

(58) Field of Classification Search

CPC ... E03C 1/1222; E03C 2001/1206; E03F 3/04

USPC ..... 138/40, 41, 44, 42, 43, 45, 46, 89, 90, 138/92, 93, 96 R, 96 T, 109

See application file for complete search history.

(56) References Cited

U.S. PATENT DOCUMENTS

| | | | | |
|---|---|---|---|---|
| 402,600 | A * | 5/1889 | Kemp | 220/235 |
| 1,955,628 | A * | 4/1934 | Gaillard et al. | 313/143 |
| 2,271,764 | A * | 2/1942 | Heil | 239/596 |
| 2,475,748 | A * | 7/1949 | Leroy | 138/90 |
| 3,018,799 | A * | 1/1962 | Hartzell et al. | 138/26 |
| 3,457,959 | A * | 7/1969 | Cooper | 138/90 |
| 3,494,504 | A * | 2/1970 | Jackson | 220/237 |
| 3,517,700 | A * | 6/1970 | Zee et al. | 138/44 |
| 3,613,936 | A * | 10/1971 | Kaiser et al. | 220/237 |
| 3,687,493 | A * | 8/1972 | Lock et al. | 285/333 |
| 3,998,245 | A * | 12/1976 | Martin | 138/89 |
| 4,000,857 | A * | 1/1977 | Moen | 239/428.5 |
| 4,303,101 | A * | 12/1981 | Tholen | 138/89 |
| 4,345,694 | A * | 8/1982 | Chambers | 220/86.3 |
| 4,505,499 | A | 3/1985 | Uglow et al. | 285/42 |
| 4,771,810 | A * | 9/1988 | Ermold et al. | 138/89 |

(Continued)

OTHER PUBLICATIONS

ExxonMobile Chemical, "Santoprene: Brand YPVs Design Guide for Termoplastic Vulcanizates (TPVs)" available at www.plasticstoday.com/sites/default/files/white%20paper_designing%20with%20TPEs.pdf pp. 1-35 (2009).

*Primary Examiner* — Patrick F Brinson
*Assistant Examiner* — Matthew Lembo
(74) *Attorney, Agent, or Firm* — David G. Rosenbaum; J. Peter Paredes; Rosenbaum IP, P.C.

(57) ABSTRACT

A flow restrictor includes an exterior tube and an interior tube disposed within the exterior tube. A first flange is disposed at a distal end of the interior tube. An annular rib extends proximally from the first flange and has an interior diameter greater than an exterior diameter of the exterior tube. A second flange is disposed at a proximal end of the exterior tube. A ring member is disposed around the exterior tube between the annular rib of the first flange and the second flange.

20 Claims, 7 Drawing Sheets

(56) References Cited

U.S. PATENT DOCUMENTS

| | | | | | |
|---|---|---|---|---|---|
| 4,830,057 | A | * | 5/1989 | Hendrickson | 138/45 |
| 4,854,543 | A | | 8/1989 | Daigle et al. | 249/95 |
| 4,874,017 | A | * | 10/1989 | Hendrickson | 138/45 |
| 4,968,197 | A | * | 11/1990 | Chen | 411/34 |
| 4,971,117 | A | * | 11/1990 | Hendrickson | 138/41 |
| 4,976,283 | A | | 12/1990 | Wildfang et al. | 137/504 |
| 4,986,312 | A | * | 1/1991 | Gute | 138/45 |
| 5,027,861 | A | * | 7/1991 | Gute | 138/45 |
| 5,035,265 | A | * | 7/1991 | Chen | 138/89 |
| 5,090,737 | A | * | 2/1992 | Brammer et al. | 285/39 |
| 5,141,029 | A | * | 8/1992 | Naugle et al. | 138/44 |
| 5,230,437 | A | * | 7/1993 | Kelly | 220/237 |
| 5,318,073 | A | * | 6/1994 | Kendrick et al. | 138/44 |
| 5,353,501 | A | * | 10/1994 | Naugle et al. | 29/890.126 |
| 5,373,971 | A | * | 12/1994 | Laffy et al. | 222/189.09 |
| 5,676,719 | A | * | 10/1997 | Stavropoulos et al. | 55/466 |
| 6,003,557 | A | * | 12/1999 | Brelig et al. | 138/89 |
| 6,237,891 | B1 | * | 5/2001 | Stiner et al. | 251/149.6 |
| 6,450,505 | B1 | * | 9/2002 | Gavin | 277/606 |
| 6,609,718 | B1 | * | 8/2003 | Gavin | 277/606 |
| 6,647,682 | B2 | | 11/2003 | Bishop | 52/302.1 |
| 6,832,624 | B1 | * | 12/2004 | Rippolone | 137/317 |
| 6,883,546 | B1 | * | 4/2005 | Kobylinski | 138/89 |
| 6,955,251 | B2 | * | 10/2005 | Kurita et al. | 192/19 |
| 7,278,450 | B1 | * | 10/2007 | Condon | 138/89 |
| 7,311,120 | B2 | * | 12/2007 | Flanagan | 138/89 |
| 7,546,847 | B2 | * | 6/2009 | Morrison et al. | 137/317 |
| 7,832,773 | B2 | * | 11/2010 | Krohn | 285/105 |
| 7,997,038 | B2 | * | 8/2011 | Warnecke et al. | 52/302.3 |
| 8,146,308 | B2 | * | 4/2012 | Warnecke et al. | 52/302.3 |
| 2004/0074549 | A1 | * | 4/2004 | Allen | 138/89 |
| 2007/0007025 | A1 | * | 1/2007 | Nock et al. | 173/213 |
| 2007/0029349 | A1 | * | 2/2007 | Glen | 222/372 |
| 2010/0147408 | A1 | * | 6/2010 | Tyson | 138/40 |
| 2011/0232793 | A1 | * | 9/2011 | Polivka et al. | 138/98 |
| 2013/0081730 | A1 | * | 4/2013 | Schwartz | 138/44 |

* cited by examiner

FLOW RESTRICTOR

CROSS-REFERENCE TO RELATED APPLICATIONS

The present application claims priority from U.S. Provisional Patent Application Ser. No. 61/351,211, filed Jun. 3, 2010, which is hereby incorporated in its entirety.

BACKGROUND OF THE INVENTION

The present invention generally relates to the field of storm water management and flood control. More particularly, the present invention relates to restricting the rate of storm water output from a drain pipe.

A storm drainage system is generally designed to accommodate and eliminate excessive amounts of storm water that might otherwise accumulate on roadways or flood homes. Typically, the storm drainage system channels the storm water from surface level where the potential for damage is high into underground pipes and/or cisterns where the storm water can be safely dissipated or stored for future dissipation. Such systems work well within design limits to protect the surface from flooding and the associated property damage and risk of harm associated therewith. However, a storm drainage system exposed to a flow of water beyond that which the system is designed to accommodate can be overloaded causing water to back up to the surface and potentially cause a flood.

Control of the rate at which storm water flows into or out of the storm drainage system can be important to prevent or inhibit such overload. For example, consider a first urban neighborhood having a modern storm drainage system designed to accommodate a tremendous volume of storm water. The first neighborhood is hit by a tremendous rainfall that is accommodated by the modern storm drainage system, and the storm water is channeled into drainage pipes to drain away from the first neighborhood as designed. A second nearby neighborhood has a storm drainage system interconnected with that of the first neighborhood. Unfortunately, the storm drainage system of the second neighborhood is incapable of accommodating the volume of water draining from the first neighborhood. Consequently, the storm drainage system of the second neighborhood becomes overloaded.

In this exemplary scenario, overload of the second neighborhood's storm drainage system makes it likely that the storm water would back up into the streets and homes and flood the second neighborhood. However, if the rate of flow of the storm water could be controlled at any stage between entering the drainage system of the first neighborhood and entering the drainage system of the second neighborhood, overload and flooding could be prevented. A need therefore exists for a device that can limit or restrict the rate of water flow into a storm drainage system to prevent overload of the system.

Storm pipes that comprise a typical storm drainage system are made from materials selected based on the size of the desired pipe, material strength, ease of handling, life expectancy, resistance to erosion, and cost, among other factors. Exemplary materials used in the construction of storm pipes include reinforced and non-reinforced concrete, corrugated polyethylene, corrugated polyvinyl chloride, and various grades of steel, as known in the art.

SUMMARY OF THE INVENTION

In one aspect of the present invention, a flow restrictor includes an exterior tube and an interior tube disposed within the exterior tube. A first flange is disposed at a distal end of the interior tube. An annular rib extends proximally from the first flange and has an interior diameter greater than an exterior diameter of the exterior tube. A second flange is disposed at a proximal end of the exterior tube. A ring member is disposed around the exterior tube between the annular rib of the first flange and the second flange.

In another aspect of the present invention, a flow restrictor includes an exterior tube and an interior tube disposed within the exterior tube. A first flange is disposed at a distal end of the interior tube. An annular rib extends proximally from the first flange and has an interior diameter greater than an exterior diameter of the exterior tube. A second flange is disposed at a proximal end of the exterior tube. A ring member is disposed around the exterior tube between the annular rib of the first flange and the second flange. A fastener holds the annular rib of the first flange in contact with the second flange via the ring member.

In a further aspect of the present invention, a flow restrictor includes an exterior tube and an interior tube disposed within the exterior tube. A first flange is disposed at a distal end of the interior tube. An annular rib extends proximally from the first flange and has an interior diameter greater than an exterior diameter of the exterior tube. A second flange is disposed at a proximal end of the exterior tube and extends radially beyond the first flange of the interior tube. A ring member is disposed around the exterior tube between the annular rib of the first flange and the second flange. A fastener provides mechanical communication between the interior tube and the exterior tube such that the ring member is in contact with the exterior tube and uncompressed in a first state and the ring member is longitudinally compressed by the fastener between the annular rib of the first flange and the second flange in a second state.

The scope of the invention is indicated in the appended claims. It is intended that all changes or modifications within the meaning and range of equivalents are embraced by the claims. The features and advantages of the invention are apparent from the following detailed description of exemplary embodiments, read in conjunction with the accompanying drawings. The detailed description and drawings are merely illustrative of the invention rather than limiting, the scope of the invention being defined by the appended claims and equivalents thereof.

DETAILED DESCRIPTION OF THE PREFERRED EMBODIMENTS

Figure 1:
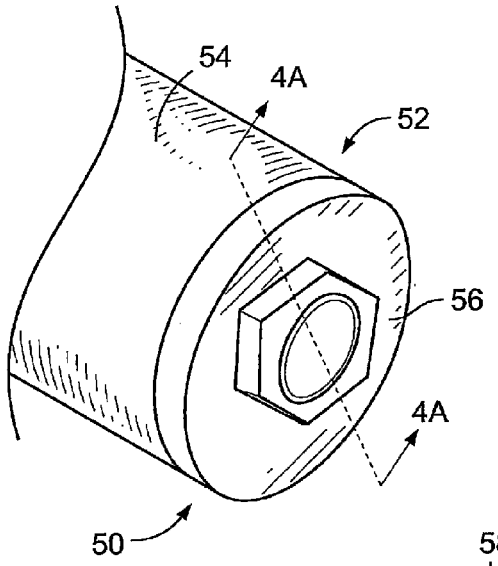
FIG. 1 is an isometric view of an embodiment of a flow restrictor attached to a pipe.

The present invention is directed to a device that may be attached to a storm drain outlet to limit or restrict the rate of water flowing out of the storm drain. Referring to FIG. 1, an embodiment of a flow restrictor 50 is illustrated attached to an outlet end 52 of a pipe or storm drain 54. For orientation purposes in understanding the FIGS., a proximal end 56 of the flow restrictor 50 is defined as the end of the flow restrictor 50 that remains outside of the storm drain 54 when the flow restrictor 50 is attached to the storm drain 54. It follows that a distal end 58 of the flow restrictor 50 is defined as the end opposite the proximal end 56. Each component of the flow restrictor 50 may also be described in terms of proximal and distal ends as defined hereinabove. Further, descriptions of cylindrical or annular components may utilize the term luminal, which means the interior surface, or the surface of the lumen of the cylindrical or annular component. The term abluminal means the opposite of luminal, and therefore refers to the exterior surface of the cylindrical or annular component. Details of the structure of the flow restrictor 50 and how the flow restrictor 50 is attached to the storm drain 54 are described hereinbelow.

The flow restrictor 50 is illustrated in FIGS. 1, 2A, 3A, and 4A. An interior member 60 includes an interior tube 62 and a flange 64 disposed at a distal end 66 of the interior tube 62. An exterior member 72 includes an exterior tube 74 and a flange 76 disposed at a proximal end 78 of the exterior tube 74. The interior tube 62 is disposed within the exterior tube 74 such that the interior and exterior tubes 62 and 74 can translate longitudinally with respect to one another. The first and second tubes 62, 74 may be in slidable contact or there may be a space therebetween.

A ring member 80 includes a luminal or interior surface 82 and an abluminal or exterior surface 84. The ring member 80 is disposed over the exterior tube 74 such that the luminal surface 82 of the ring member 80 is disposed around and in contact with the exterior tube 74. An annular rib 102 extends proximally from the flange 64 and has an interior diameter greater than an exterior diameter of the exterior tube 74. When assembled, the ring member 80 is disposed between the annular rib 102 and the second flange 76 and the second flange 76 extends radially beyond the exterior surface 84 of the ring member 80. In a first or relaxed state, as depicted in FIG. 4A, the ring member 80 is uncompressed and in contact with the exterior tube 74 and the first and second flanges 64, 76 (via the annular rib 102).

Figure 4A:
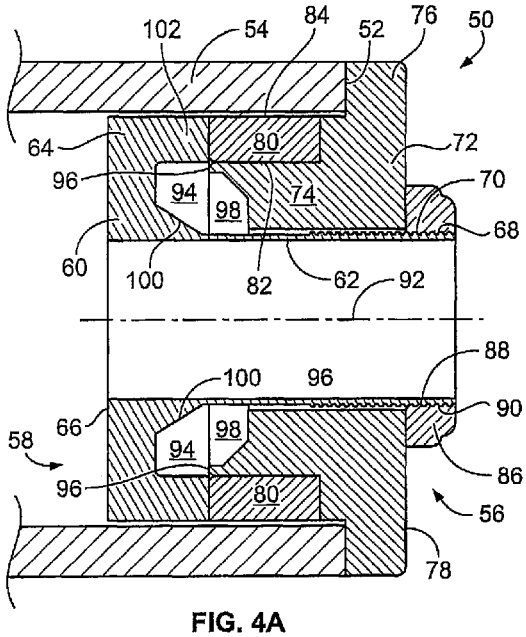
FIG. 4A is a cross-sectional view of the flow restrictor of FIG. 1 in taken generally along the lines 4A-4A of FIG. 1.

An annular cross-section of the ring member 80 is illustrated in FIG. 4A as generally rectangular. In fact, the annular cross-section may have any shape as known in the art, including by way of example and not limitation, circular, elliptical, triangular, pentagonal, or any regular or irregular shape having any number of sides. Materials for fabrication of the ring member 80 may comprise any material that can be compressed in a first axis, for example, longitudinally, to force expansion in an orthogonal second axis. When longitudinally compressed and radially confined by an interior wall of, for example, the pipe 54, the ring member 80 experiences a radial compression between the pipe 54 and the exterior tube 74. It is desirable that the ring member 80 forms a water tight seal when compressed against the typical materials used in construction of a storm drain pipe, for example, concrete, as described hereinabove. Suitable materials include by way of example and not limitation, a thermoplastic elastomer (TPE) such as a styrenic block copolymer, a polyolefin blend, an elastomeric alloy, a thermoplastic polyurethane, a thermoplastic copolyester, or a thermoplastic polyamide. In one preferred embodiment, the ring member 80 is fabricated from an elastomer alloy sold under the Santoprene® trademark by Monsanto Company.

Figure 4B:
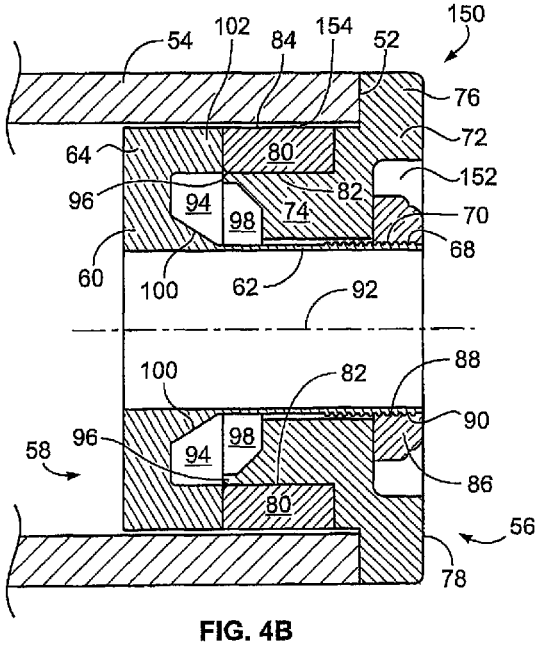
FIG. 4B is a cross-sectional view of the flow restrictor of FIG. 2B taken generally along the lines 4B-4B of FIG. 2B.

Referring to FIG. 4B, in the first or relaxed state, the ring member 80 is uncompressed and in contact with the exterior tube 74 such that an annular gap 154 exists between the pipe 54 and the abluminal or exterior surface 84 of the ring member 80. In a second or compressed state, the first and second flanges 64 and 76 are forced together longitudinally such that the ring member 80 is longitudinally compressed between the annular rib 102 of the first flange 64 and the second flange 76, as illustrated in FIG. 4F, for example. Such longitudinal compression of the ring member 80 causes the exterior surface 84 of the ring member 80 to extend radially beyond the first flange 64 and fill the gap 154. When the exterior surface 84 of the ring member 80 is radially expanded as illustrated in FIGS. 4F and 4G, the ring member 80 experiences radial compression between the exterior tube 74 and the pipe 54. Such radial compression of the ring member 80 facilitates a water-tight seal between the flow restrictor 50 and the pipe 54 and holds the flow restrictor 50 securely in place at the outlet end 52 of the pipe 54. Flow through the pipe 54 is therefore restricted by the interior tube 62, which is smaller in diameter than the pipe 54.

The force of compression causing the ring member to diametrically expand and form a seal against a constraining surface, as above-described, is provided by forced relative translation of the first flange 64 toward the second flange 76. The first and second flanges 64, 76 can be forced together by a fastener 86 that provides mechanical communication between the first flange 64 and the second flange 76. The fastener 86 can encompass any of several distinct embodiments as illustrated in the FIGS. and described further below.

Returning to FIGS. 1, 2A, 3A, and 4A, in this embodiment, the flow restrictor 50 in an assembled state includes the interior tube 62 disposed within and extending through the exterior tube 74 such that the interior tube 62 and the exterior tube 74 are generally concentric about a longitudinal axis 92. The flange 76 extends radially away from the longitudinal axis 92 beyond the exterior or abluminal surface 84 of the ring member 80. The first flange 64 includes an annular groove 94 that can accommodate a distal surface 96 of the exterior tube 74 when the interior tube 62 and the exterior tube 74 are longitudinally forced together. Similarly, the exterior tube 74 includes an annular recess 98 that can accommodate a proximal surface 100 of the first flange 64 when the interior member 60 and the exterior member 72 are forced together longitudinally.

In one embodiment, the fastener 86 is a nut 86, which is configured to include threads 88 on a luminal surface 90 thereof. An exterior or abluminal surface 68 of the interior tube 62 includes threads 70, which are complementary to the threads 88 such that the nut 86 may be threadably attached to the interior tube 62. Tightening the nut 86 forces relative translation of the first and second flanges 64, 76 toward one another.

Figure 2A:
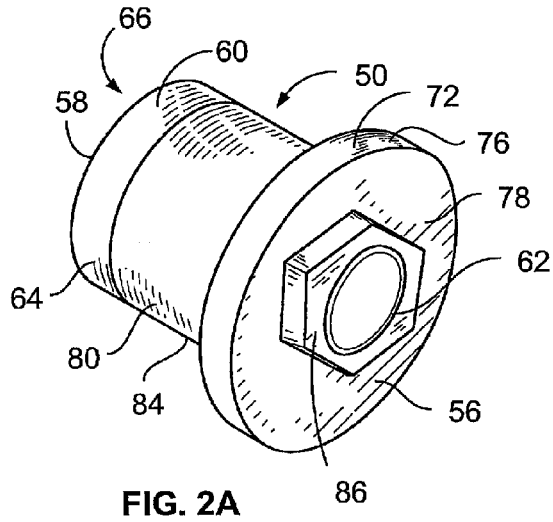
FIG. 2A is an isometric view of the flow restrictor of FIG. 1.
Figure 2B:
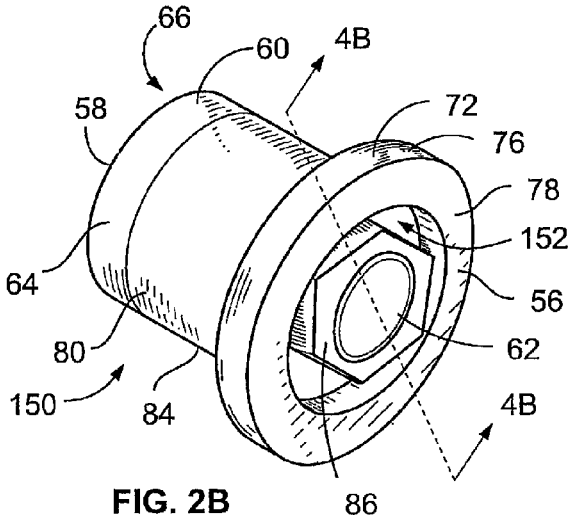
FIG. 2B is an isometric view of another embodiment of a flow restrictor.

Referring to FIGS. 2B, 4B, and 4F, another embodiment of a flow restrictor 150 is similar to the flow restrictor 50 described hereinabove with regard to FIGS. 2A and 4A. However, in this embodiment, the proximal end 78 of the exterior member 72 includes a central depression 152 that is configured to accommodate the fastener 86 when the fastener 86 engages the threads 70 disposed on the exterior or abluminal surface 68 of the interior tube 62.

In another embodiment (not shown), the fastener 86 may comprise a fastening member on each of the first and second members 60, 72 or tubes 62, 74. For example, one or more buttons or protrusions (not shown) could extend outwardly from the exterior surface 68 of the interior tube 62. One or more check-mark shaped bayonet slots (not shown), each having a first portion disposed at a non-orthogonal angle relative to the longitudinal axis 92 and a second portion disposed generally parallel to the longitudinal axis, could be formed into an interior surface of the outer tube 74. Subsequent to longitudinal alignment of each button with a corresponding bayonet slot, application of a relative torque between the interior tube 62 and the second flange 76 drives each button proximally in each slot, resulting in the forced translation of the first flange 64 toward the second flange 76.

Figure 4C:
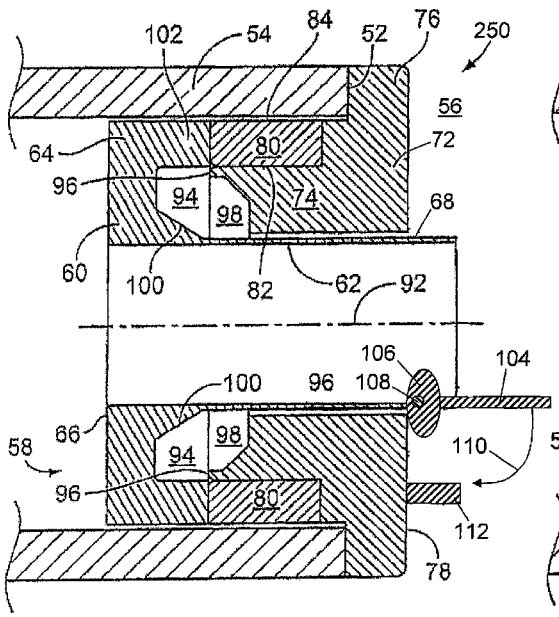
FIG. 4C is a cross-sectional view of a further embodiment of a flow restrictor taken generally along the lines 4A-4A of FIG. 1.

In a further embodiment of a flow restrictor 250 illustrated in FIG. 4C, a lever arm 104 having a cam 106 fixedly attached via the pivot point 108 to a portion of the interior tube 62 within a slot (not shown) cut longitudinally in the wall of the interior tube 62. In the relaxed or uncompressed first state, the lever arm 104 exerts no substantial force on the proximal end 78 of the exterior member 72 via the cam 106. However, when the lever arm 104 is rotated around the pivot point 108 in the direction of the arrow 110 as illustrated, rotational motion of the cam 106 provides a forced translation of the first and second flanges 64, 76 toward one another. When the cam 106 has been rotated by about 90 degrees, a latch or catch 112 attached to the distal surface of the second flange 76 may be used to secure the lever arm 104 from snapping back under the force of compression.

Figure 4D:
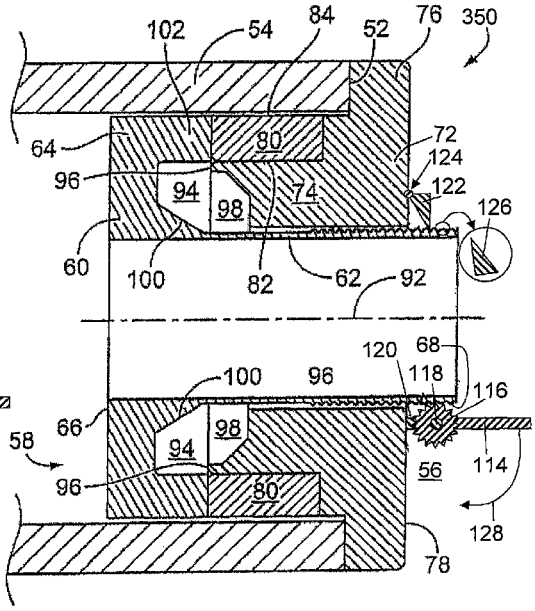
FIG. 4D is a cross-sectional view a still further embodiment of a flow restrictor taken generally along the lines 4A-4A of FIG. 1.

In another embodiment of a flow restrictor 350 illustrated in FIG. 4D, a ratcheting lever arm 114 is connected via an internal ratchet mechanism as known in the art (not shown) to a gear 116. The gear 116 is free to rotate on a pivot point 118 that is attached to the proximal end 78 of the exterior member 72 via a mounting member 120. A pawl 122 is also attached to the proximal end 78 of the exterior member at a pawl pivot point 124. The pawl 122 is biased by a spring (not shown) or other forcing member as known in the art to remain in contact with ridges 126, which are disposed on the exterior surface 68 of the interior tube. Each ridge 126 has a smooth or sloped proximal side and a distal side that is generally orthogonal to or slightly angled distally from orthogonal to the longitudinal axis 92 (see expanded view in FIG. 4D). The smooth side of each ridge 126 is designed to slip past the pawl 122 when translated proximally relative to the pawl 122. The distal side of each ridge 126 is designed to catch on the pawl 122, thereby preventing distal translation of the interior tube 116 relative to the pawl 122.

Subsequent to insertion of the interior tube 62 through the exterior tube 74, the ridges 126 engage the gear 116 while slipping proximally past the pawl 122. The ratcheting lever arm 114 engages the gear 116 when rotated from a first position as illustrated in FIG. 4D in the direction of the arrow 128. The gear 116 engages the ridges 126 to apply a forced translation of the first and second flanges 64, 76 toward one another. The ratcheting lever arm 114 may be ratcheted back to the first position to further engage the gear 116 in the direction of the arrow 128 as many times as necessary to sufficiently force the first and second flanges 64, 76 together. The pawl 122 may be released by taking pressure off the ridge 126 via the ratcheting lever arm 114 and rotating the pawl 122 away from the interior tube 62.

Figure 4E:
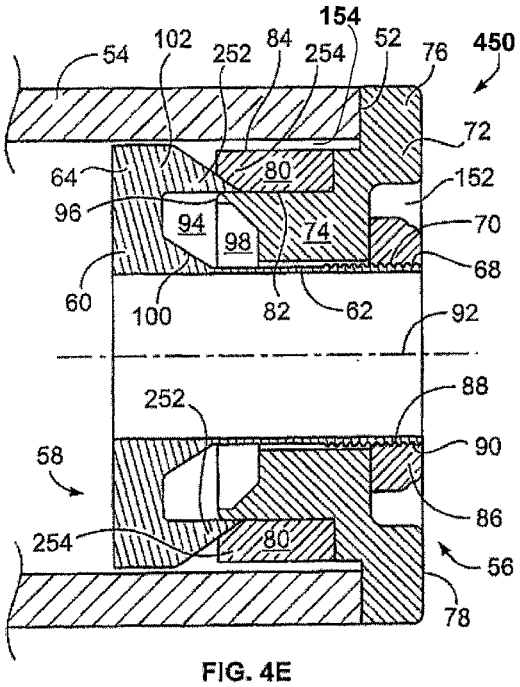
FIG. 4E is a cross-sectional view of another embodiment of a flow restrictor taken generally along the lines 4B-4B of FIG. 2B.
Figure 4F:
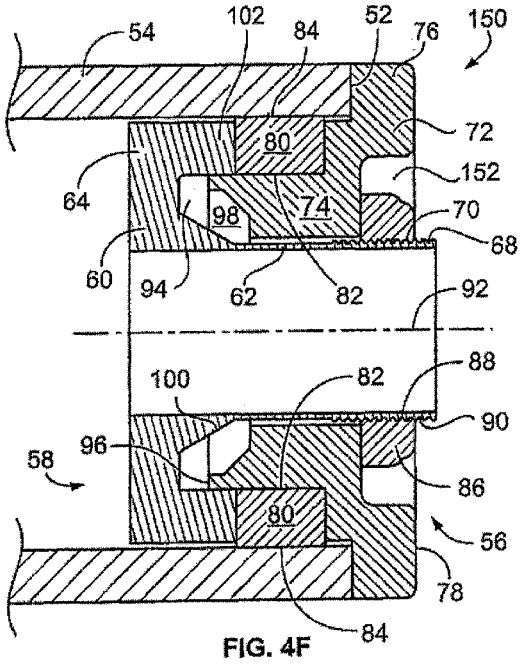
FIG. 4F is a cross-sectional view of the flow restrictor of FIG. 4B depicting a ring member in a compressed state forming a seal against a pipe interior.
Figure 4G:
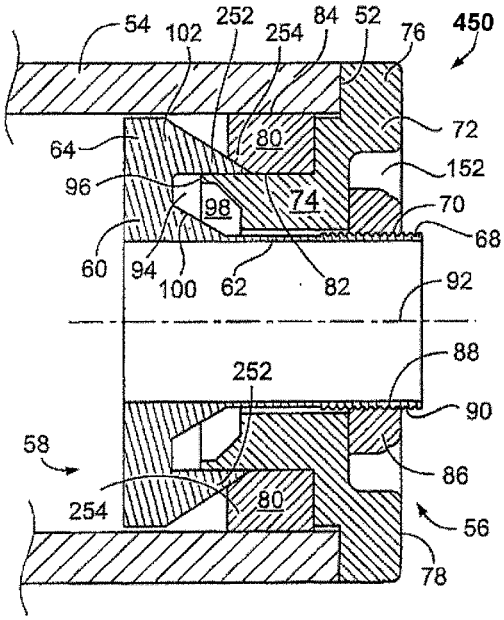
FIG. 4G is a cross-sectional view of the flow restrictor of FIG. 4E depicting a ring member in a compressed state forming a seal against a pipe interior.

Referring to FIGS. 4E and 4G, a further embodiment of a flow restrictor 450 is similar to the flow restrictor 150 described hereinabove with regard to FIGS. 2B, 4B, and 4F. However, in this embodiment, an annular cross-section of the annular rib 102 includes a tapered portion 252 that includes an exterior radial dimension that radially decreases proximally along a longitudinal axis of the interior tube 62. Further, an annular cross-section of the ring member 80 includes a tapered portion 254 that includes an interior radial dimension that radially increases distally along a longitudinal axis of the ring member 80.

Referring to FIG. 4E, in this embodiment, in a first or relaxed state prior to application of a forced relative translation of the first and second flanges 64, 76 toward one another, the ring member 80 is longitudinally uncompressed and in contact with the exterior tube 74 and the first and second flanges 64, 76 (via the tapered portion 252 of the annular rib 102). The tapered portion 254 of the ring member 80 is generally complementary to the tapered portion 252 of the annular rib 102. The annular gap 154 exists between the pipe 54 and the exterior surface 84 of the ring member 80. Forced translation of the first and second flanges 64, 76 toward one another causes the first flange 64 to compress the ring member 80 longitudinally against the second flange 76 and causes the tapered portion 252 to force the ring member 80 radially outward away from the exterior ring 74. Upon radial outward expansion of the exterior surface 84 of the ring member 80, the exterior surface 84 contacts the pipe 54. Thus, a combination of longitudinal compression and being forced radially outward causes the ring member 80 to fill the gap 154. Upon contact of the exterior surface 84 and the pipe 54, further translation of the first and second flanges 64, 76 toward one another compresses the ring member between the pipe 54 and the exterior tube 74. FIG. 4G illustrates the flow restrictor 450 in a second or compressed state, where the ring member 80 is compressed between the pipe 54, the exterior tube 74, the tapered portion 252, and the second flange 76. Such compression provides a water-tight seal between the flow restrictor 450 and the pipe 54 and holds the flow restrictor 450 securely in place at the outlet end 52 of the pipe 54.

Figure 3A:
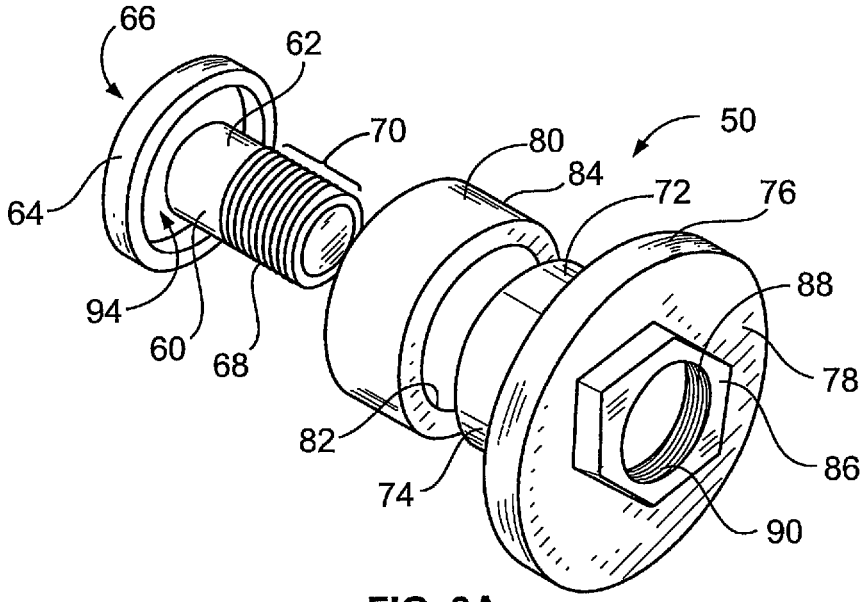
FIG. 3A is an exploded isometric view of the flow restrictor of FIG. 2A.
Figure 3B:
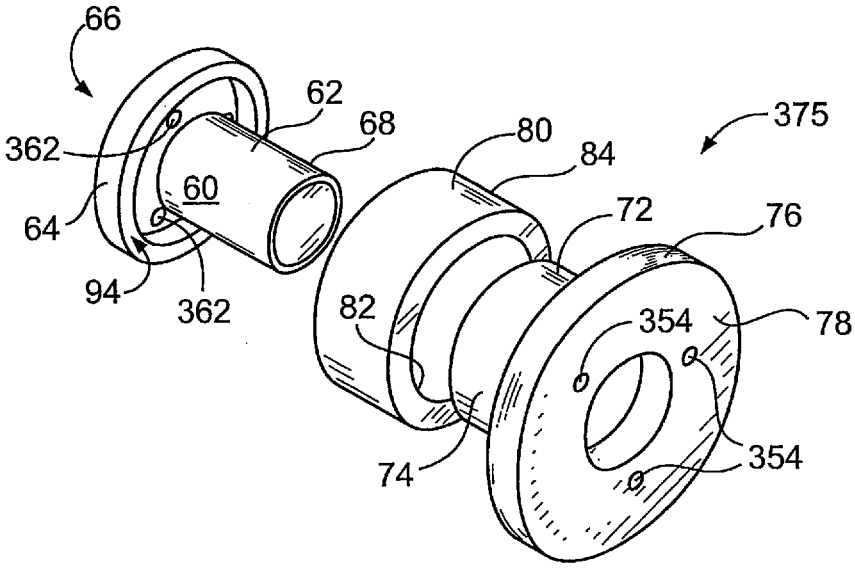
FIG. 3B is an exploded view of another embodiment of a flow restrictor.
Figure 5:
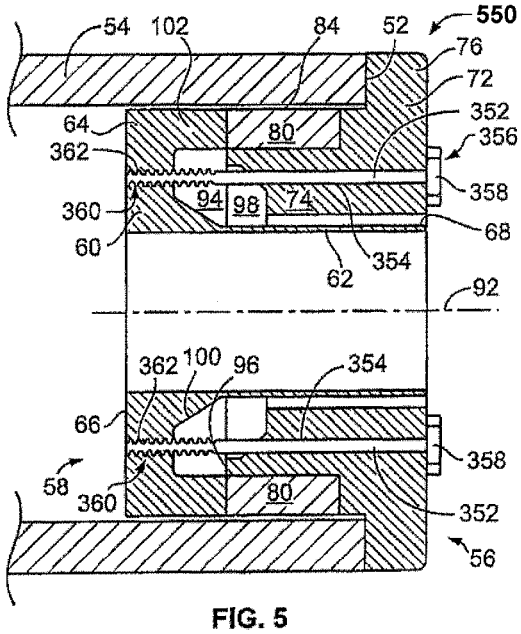
FIG. 5 is a partial cross-sectional view of a further embodiment of a flow restrictor similar to the embodiment of FIG. 3B.

Another embodiment of a flow restrictor 550 is illustrated in FIG. 5. This embodiment is similar to the embodiment described hereinabove with regard to FIGS. 1, 2A, 3A, and 4A except for the following differences. The flow restrictor 550 lacks a nut 86 and the interior tube 62 does not include the threads 70 on the abluminal surface 68 thereof. Instead, the fastener 86 in this embodiment is a plurality of threaded members 352, for example, bolts 352 that are disposed through smooth bores 354 disposed through the exterior member 72. As illustrated in FIG. 5, proximal ends 356 of the bolts 352 include a bolt head 358, for example a hex head or an Allen cap head, or other bolt head as known in the art. Distal ends 360 of the bolts 352 in this embodiment threadably engage threaded bores 362 disposed through the interior member 60. Tightening the plurality of bolts 352 forces the first and second flanges 64 and 76 together longitudinally. Three threaded members 352 are preferred, but two threaded members 352 or four or more threaded members 352 may also be utilized. For example, flow restrictor 375 illustrated in FIG. 3B utilizes three threaded members 352 (not shown) that extend through the smooth bores 354 but is otherwise identical to the flow restrictor 550 illustrated in FIG. 5.

Figure 6:
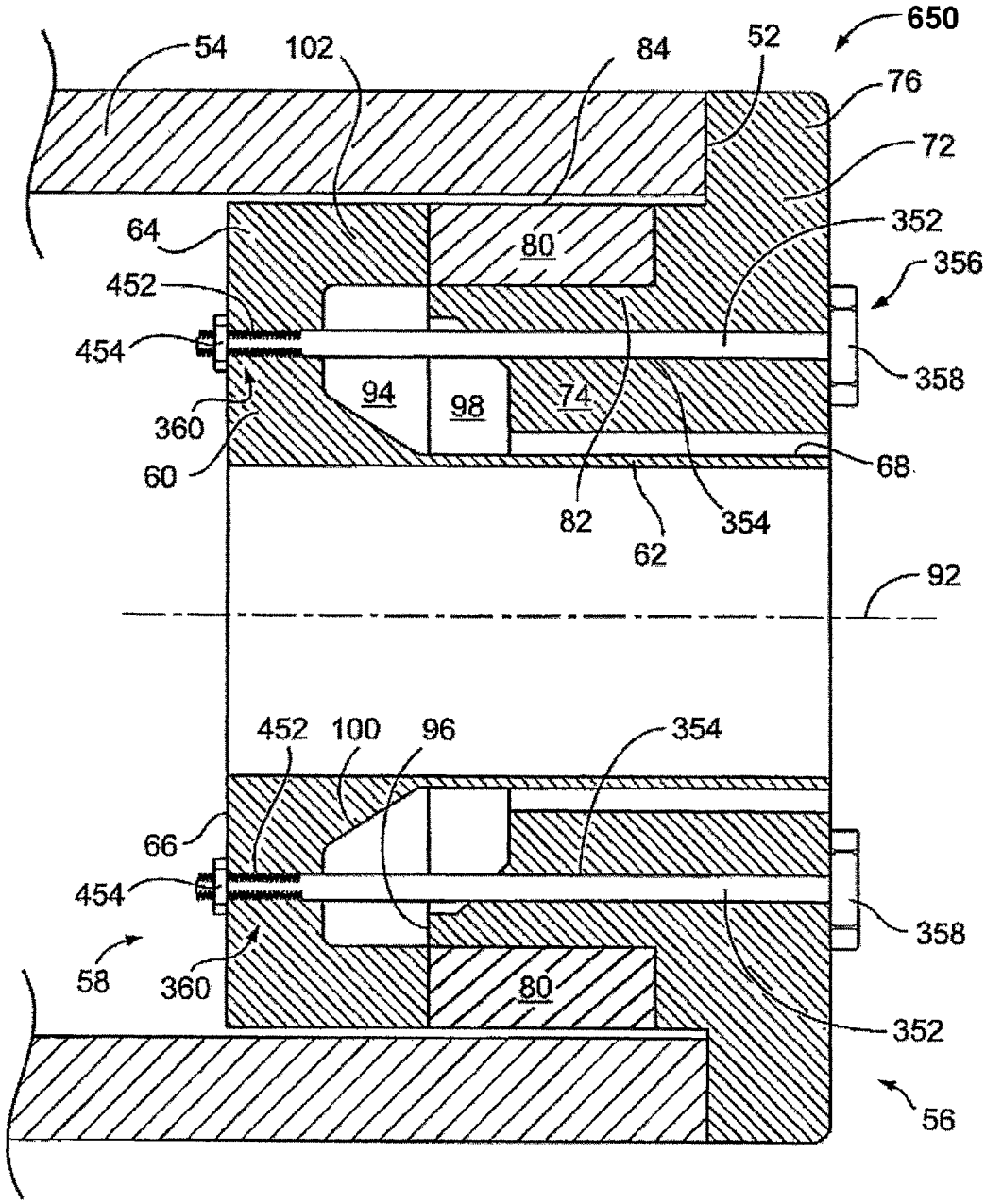
FIG. 6 is a partial cross-sectional view of yet another embodiment of a flow restrictor similar to the embodiment of FIG. 5.

Yet another embodiment of a flow restrictor 650 is illustrated in FIG. 6. This embodiment is substantially similar to the flow restrictors 550, 375 described hereinabove with regard to FIGS. 5 and 3B, respectively, except for the following differences. The interior member 60 lacks threaded bores 362 and instead includes smooth bores 452. The fastener in this embodiment comprises the threaded members 352 that are disposed through the smooth bores 354 and 452 (disposed through the exterior and interior members 72 and 60, respectively) and a plurality of nuts 454 that threadably engage the distal ends 360 of the plurality of threaded members 352. In another embodiment, the nuts 454 may be seated within recesses (not shown) in the distal end 66 of the interior member 60 to inhibit rotation of the nuts 454 when the threaded members 352 are tightened. Alternatively, in a further embodiment, split washers (not shown) or other forms of washers may be included, or a plurality of rods having threads engaged by nuts at both ends may be substituted for the plurality of bolts 352. The number and size of the plurality of threaded members 352 may vary depending on the overall size of the flow restrictor 350, 375, 450 and/or the material used to fabricate the flow restrictor 350, 375, 450.

The present invention should not be considered limited to the particular embodiments and examples described above, but rather should be understood to cover all aspects of the invention as fairly set out in the attached claims. For example, the flow restrictor embodiments 50, 250, 350, 550, 650 may also include the central depression 152, or the flow restrictor embodiments 50, 150, 250, 350, 550, 650 may also include the tapered portion 252 of the annular rib 102, and/or the tapered portion 254 of the ring member 80. Further, any of the fastener 86 embodiments described hereinabove may be used interchangeably, as appropriate, with any combination of the first and second members 60, 72 and the ring member 80.

The interior and exterior members 60, 72 and the fastener 86 are generally rigid components and may be made from any rigid material that can be mechanically stressed without deformation. Portions of each of the rigid components may experience bending stress, which is a combination of both compression and tension. The rigid components can be manufactured from solid blocks of material having non-essential material left in place, or may be manufactured from relatively thin-walled material omitting portions of each component that may be non-essential. For example, the nut 86 may be manufactured to be solid between the interior surface 90 and an exterior surface of the nut 86, as depicted, for example, in FIGS. 4E-4G. Alternatively, the nut 86 may include an annular hollow recess (not shown) opening to a distal side of the nut. Such a recess could save on material costs and make the nut lighter and easier to handle. Each rigid component may be integrally made via, for example, injection molding or extrusion, or other method as known in the art. Alternatively each rigid component may be made from several parts each made via a method as known in that art and joined or bonded together, for example, via chemical adhesive, welding, or other method as known in the art.

Therefore, factors to consider in selection of the rigid material are the size of the rigid components, the weight of the material, material strength, ease of handling, ease of manufacture, life expectancy, resistance to erosion or corrosion, cost of raw materials, and cost of manufacture, among other factors. Material suitable for use in fabrication of the rigid components include by way of example and not limitation, metals or alloys such as stainless steel, thermoplastics, or glass reinforced nylons.

A flow restrictor device is presented that provides for simple attachment to a drain pipe for the purpose of restricting the flow of water therefrom. Such a simply attached device has great utility in the prevention of flood damage caused by the overloading of flood control systems.

While the present invention has been described with reference to its preferred embodiments, those of ordinary skill in the art will understand and appreciate that variations in materials, dimensions, geometries, and fabrication methods may be or become known in the art, yet still remain within the scope of the present invention which is limited only by the claims appended hereto. The exclusive rights to all modifications which come within the scope of the appended claims are reserved.

What is claimed is:

1. A flow restrictor, comprising:

an exterior tube having an inner wall surface and an outer wall surface;

an interior tube having an inner wall surface and an outer wall surface, the interior tube disposed concentrically within the exterior tube, wherein at least a portion of the interior tube is disposed between a proximal end of the exterior tube and a distal end of the exterior tube and inside the inner wall surface of the exterior tube;

a first flange disposed at a distal end of the interior tube;

an annular rib extending proximally from the first flange and having an interior diameter greater than an exterior diameter of the exterior tube;

a second flange disposed at the proximal end of the exterior tube; and a ring member disposed around the exterior tube between the annular rib of the first flange and the second flange.

2. The flow restrictor of claim 1, wherein in a first state, the ring member is uncompressed and in contact with the exterior tube and the first and second flanges.

3. The flow restrictor of claim 2, wherein in a second state, the ring member is longitudinally compressed between the annular rib of the first flange and the second flange.

4. The flow restrictor of claim 3, wherein an exterior radius of the ring member extends radially beyond the first flange in the second state.

5. The flow restrictor of claim 1, wherein the second flange extends radially beyond an exterior surface of the ring member.

6. The flow restrictor of claim 1, wherein the ring member is fabricated from a thermoplastic elastomer selected from the group of thermoplastic elastomers consisting of: styrenic block copolymers, polyolefin blends, elastomeric alloys, thermoplastic polyurethanes, thermoplastic copolyesters, and thermoplastic polyamides.

7. A flow restrictor, comprising:

an exterior tube having an inner wall surface and an outer wall surface;

an interior tube having an inner wall surface and an outer wall surface, the interior tube disposed concentrically within the exterior tube, wherein at least a portion of the interior tube is disposed between a proximal end of the exterior tube and a distal end of the exterior tube and inside the inner wall surface of the exterior tube;

a first flange disposed at a distal end of the interior tube;

an annular rib extending proximally from the first flange and having an interior diameter greater than an exterior diameter of the exterior tube;

a second flange disposed at the proximal end of the exterior tube;

a ring member disposed around the exterior tube between the annular rib of the first flange and the second flange; and a fastener that holds the annular rib of the first flange in contact with the second flange via the ring member.

8. The flow restrictor of claim 7, wherein the second flange extends radially beyond an exterior surface of the ring member.

9. The flow restrictor of claim 7, wherein the interior tube and the second flange are in mechanical communication via the fastener such that the ring member is in contact with the exterior tube and uncompressed in a first state.

10. The flow restrictor of claim 9, wherein the interior tube and the second flange are in mechanical communication via the fastener such that the ring member is compressed at least between the annular rib of the first flange and the second flange in a second state.

11. The flow restrictor of claim 7, wherein an annular cross-section of the annular rib includes an exterior radial dimension that radially decreases proximally along a longitudinal axis of the interior tube.

12. The flow restrictor of claim 11, wherein an annular cross-section of the ring member includes an interior radial dimension that radially increases distally along a longitudinal axis of the ring member.

13. The flow restrictor of claim 7, wherein the annular rib of the first flange and the interior tube define an annular groove therebetween.

14. The flow restrictor of claim 13, wherein the wall of the exterior tube includes a recess disposed in the distal end of the exterior tube and concentric with a longitudinal axis of the exterior tube.

15. A flow restrictor, comprising:

an exterior tube having an inner wall surface and an outer wall surface;

an interior tube having an inner wall surface and an outer wall surface, the interior tube disposed concentrically within the exterior tube, wherein at least a portion of the interior tube is disposed between a proximal end of the exterior tube and a distal end of the exterior tube and inside the inner wall surface of the exterior tube;

a first flange disposed at a distal end of the interior tube;

an annular rib extending proximally from the first flange and having an interior diameter greater than an exterior diameter of the exterior tube;

a second flange disposed at the proximal end of the exterior tube and extending radially beyond the first flange of the interior tube;

a ring member disposed around the exterior tube between the annular rib of the first flange and the second flange; and a fastener that provides mechanical communication between the interior tube and the exterior tube such that the ring member is in contact with the exterior tube and uncompressed in a first state and the ring member is longitudinally compressed by the fastener between the annular rib of the first flange and the second flange in a second state.

16. The flow restrictor of claim 15, wherein longitudinal compression of the ring member in the second state causes an outer radius of the ring member to extend radially beyond the first flange.

17. The flow restrictor of claim 16, wherein the fastener comprises a plurality of threaded members disposed longitudinally through accommodating bores in the exterior tube.

18. The flow restrictor of claim 16, wherein at least a portion of the outer wall of the interior tube is threaded and extends proximally through the exterior tube, and the fastener comprises a nut that threadably attaches to the threaded portion of the outer wall of the interior tube on a proximal side of the exterior tube.

19. The flow restrictor of claim 16, wherein the fastener comprises a lever arm having a cam fixedly attached via a pivot point to the interior tube, wherein rotational motion of the cam provides a forced translation of the first and second flanges toward one another.

20. The flow restrictor of claim 16, wherein the fastener comprises a ratcheting lever arm attached to a gear that is attached to the proximal end of the exterior tube, a pawl that is attached to the proximal end of the exterior tube, and ridges that are disposed on a portion of the outer wall of the interior tube, wherein rotational engagement of the gear with the ridges provides a forced translation of the first and second flanges toward one another.

* * * * *